United States Patent [19]

Bohn

[11] 4,446,639

[45] May 8, 1984

[54] ANGLING SNOW BLADE

[76] Inventor: Donald L. Bohn, 7429 Glenvale Dr., Omaha, Douglas County, Nebr. 68134

[21] Appl. No.: 400,825

[22] Filed: Jul. 22, 1982

[51] Int. Cl.[3] ..... E01H 5/06

[52] U.S. Cl. ..... 37/280; 37/283; 172/782

[58] Field of Search ..... 37/283, 280, 241, 264–266, 37/234, 236, 117.5; 172/782

[56] References Cited

U.S. PATENT DOCUMENTS

| | | | |
|---|---|---|---|
| 2,388,985 | 11/1945 | Martin | 37/283 |
| 2,988,831 | 6/1961 | Burns | 37/280 |
| 3,055,126 | 9/1962 | Emhof | 37/280 |
| 3,154,336 | 10/1964 | Nelson | 37/265 |
| 3,208,166 | 9/1965 | Prouly | 37/280 |
| 3,374,562 | 3/1968 | Glesmann | 37/280 |
| 3,391,478 | 7/1968 | Astill | 37/280 |
| 4,077,139 | 3/1978 | Fagervold et al. | 37/280 |
| 4,208,812 | 6/1980 | Brownly | 37/280 |

FOREIGN PATENT DOCUMENTS

| | | | |
|---|---|---|---|
| 271554 | 6/1969 | Austria | 37/280 |
| 759663 | 5/1967 | Canada | 37/266 |
| 924751 | 5/1963 | United Kingdom | 37/117.5 |
| 1426898 | 7/1974 | United Kingdom | 37/117.5 |
| 2023094 | 12/1979 | United Kingdom | 37/117.5 |

*Primary Examiner*—E. H. Eickholz

*Attorney, Agent, or Firm*—Henderson & Sturm

[57] ABSTRACT

An improved angling snow blade, of the type which pushes snow to the left or right as the supporting vehicle alternates directions across an area to be cleared, has a right (28) and left (29) side panel attached to hinge about the upper edge of the blade, whereby wider swaths can be taken as a result of either side panel blocking the snow from previously cleared areas. A removable bottom panel (31) hingedly attached at its leading edge to the lower leading edge of the side panels enables the improved blade to carry snow from one location and dump it in another and to pull snow away from vertical obstacles, particularly those surrounding corners.

6 Claims, 5 Drawing Figures

ANGLING SNOW BLADE

TECHNICAL FIELD

This invention relates to blades for clearing snow which are attached to the front end of jeeps, pickup trucks and the like, and which typically have mechanical facilities to be angled left or right and to be raised a limited distance above ground level. More particularly, the present invention relates to snow blades having additional structure which permits more efficient operation than the conventional arrangement.

BACKGROUND ART

Ordinarily, a medium to small sized paved area, such as a driveway or parking lot is most efficiently cleared by an operator driving a utility type vehicle to which is affixed at its front end a pusher type snow blade. This blade is typically about seven to eight feet in width and twenty-five to twenty-eight inches in height. It has a vertical cross-section in the form of a somewhat circular segment having a more rounded portion at its top, such as in the shape of a comma (",").

Most often the basic procedure for clearing snow from such an area is, beginning along one side thereof, to make a series of parallel trips in alternate directions, thus progressing in a single lateral direction across the area, all the while moving the mass of snow in said lateral direction by alternating the angled orientation of the blade each time the parallel trip direction is reversed. Even though the blade is appropriately angled so as to move the snow in one desired lateral direction, a portion of the blade must project into the already cleared area in order to avoid returning some snow across the edge of the projecting portion of the blade. For this reason the full width of the blade is not available for moving snow in the desired lateral direction. This deficiency becomes progressively worse as the operation continues, due to the accumulation of cleared snow on top of the adjacent uncleared area. Depending upon the depth of the snow, as much as one-third to one-half of the blade must extend over already cleared areas during much of the operation.

Another problem with the use of equipment of this type is that all of the snow moved must be pushed along the pavement. Only heavier and more complex equipment, such as front-end loaders or bulldozers equipped with special snow shovels, can actually lift and carry large accumulations of snow from one place to another. Thus, the type of equipment described hereinabove is handicapped in clearing the snow from some medium and larger-sized areas, in particular when the snow depth is great.

An additional problem is confronted when equipment of this type must clear the snow from the corner of an area which may have surrounding obstacles, such as retaining walls, buildings, steep banks or combinations of any two of them. When confronted with this situation, the operator of the equipment must get out of the vehicle and resort to hand shoveling.

DISCLOSURE OF THE INVENTION

An object of the present invention is the provision of an improved blade for clearing snow from paved areas.

Another object is to provide for a blade for clearing snow from paved areas which, when angled to move snow in a desired lateral direction, will move more snow in that direction, given the length of the blade.

A further object of the invention is the provision of a blade for clearing snow which may be easily converted into a shovel for carrying snow from one place to another.

Still another object is to provide a blade for clearing snow which can be converted to a device which is capable of pulling snow in the reverse direction.

A still further object of the invention is to provide a blade for clearing snow which can easily and conveniently remove snow from the corners of paved areas which are bounded by vertical obstacles.

Yet another object is the provision of a blade for clearing snow for which the hereinabove referred to conversions can be accomplished by a single operator.

In a more general sense, it is an object of this invention to accessorize a conventional snow clearing blade with left and right side panels, each of which may be pivoted independently of the other, about an axis which is colinear with the top edge of the blade. A hydraulic cylinder connected between the snow blade and each side panel moves it between a position level with the ground in its lowermost position and a position somewhat clear of the edge of the blade in its uppermost position. Consequently, each side panel can alternately be positioned to block the escape of snow around one side edge of the blade while permitting the escape of snow across the other.

Provision is also made for a removable, pivotable, bottom panel which, along with the side panels converts the blade into a shovel for transporting snow from one place to another. When the two sides and bottom panel are simultaneously raised, snow is dumped. The bottom panel can also be pivoted to a generally vertical attitude, independent of the side panels and disposed away from the blade, for trapping snow between the two and pulling it away from vertical obstacles.

These and other objects, advantages and novel features of the present invention will become apparent from the following detailed description of the invention when considered in conjunction with the accompanying drawings.

BEST MODE FOR CARRYING OUT THE INVENTION

Figure 1:
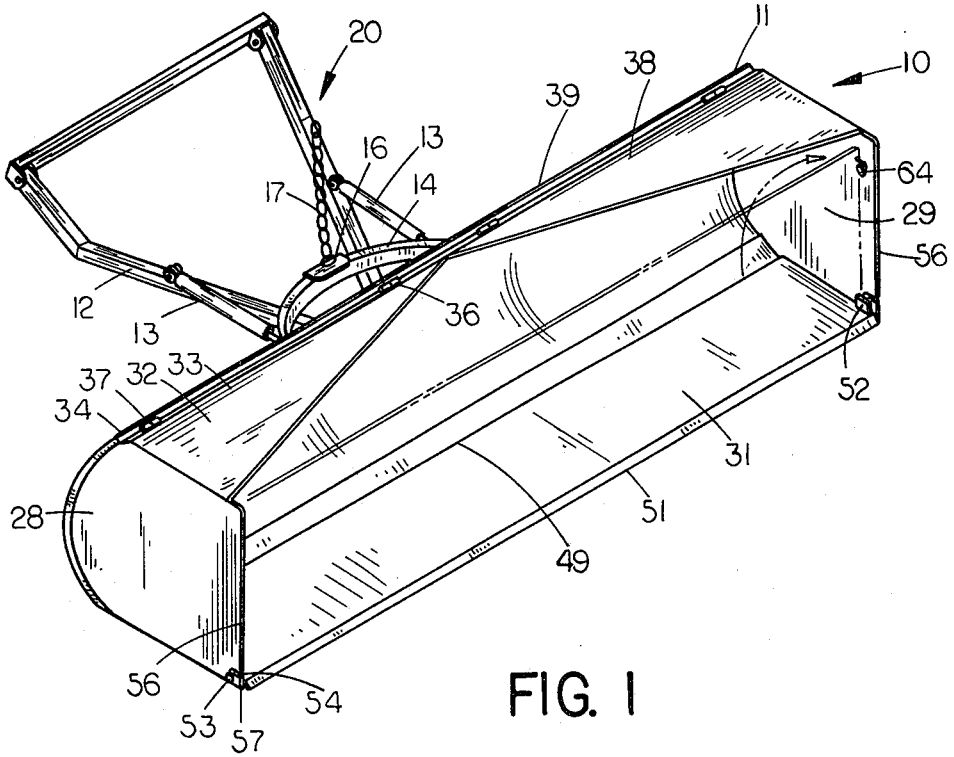
FIG. 1 is a perspective view of the improved snow blade showing both side panels in a lower position, the bottom panel in solid lines oriented so as to permit the transportation of snow as well as in phantom lines oriented so as to permit the pulling of snow away from a vertical obstacle.
Figure 2:
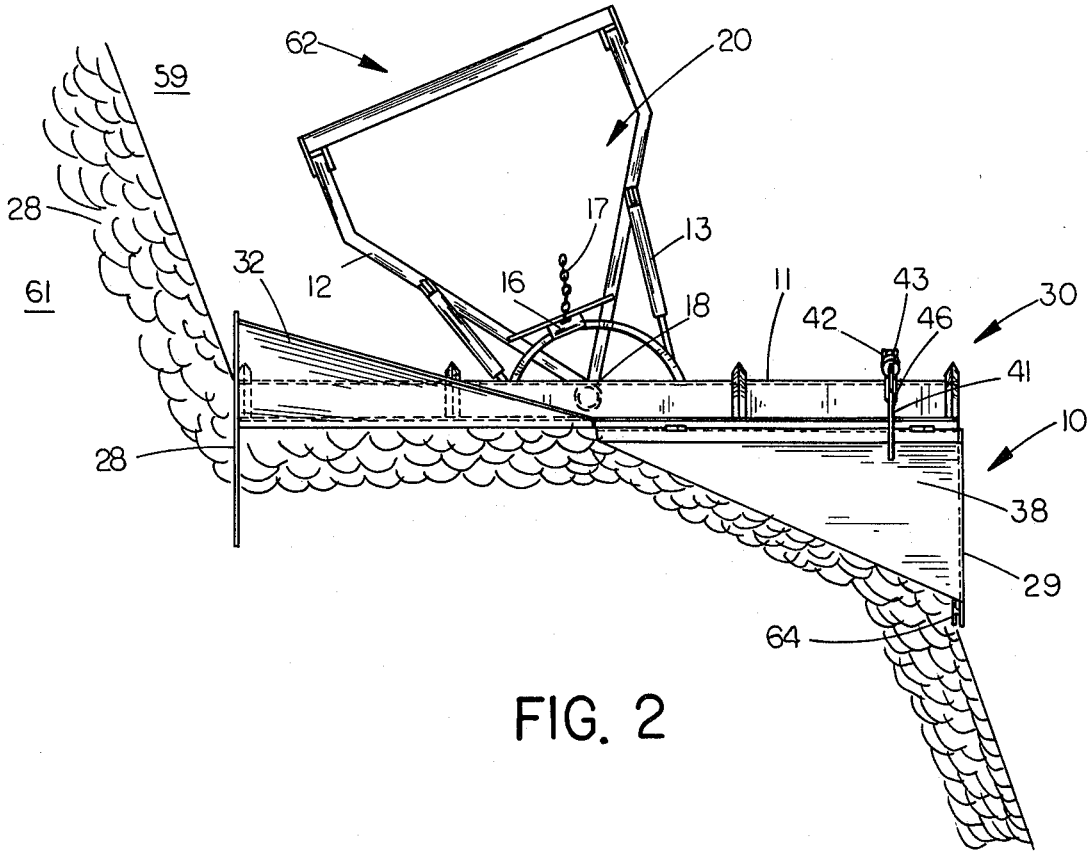
FIG. 2 is a top plan view showing the snow blade of the present invention without the bottom panel in place, the right (as one faces in the direction of pushing the snow) side panel in upper position for permitting the escape of snow about the right side edge of the blade, and the left side panel in lower position for blocking the escape of snow.
Figure 4:
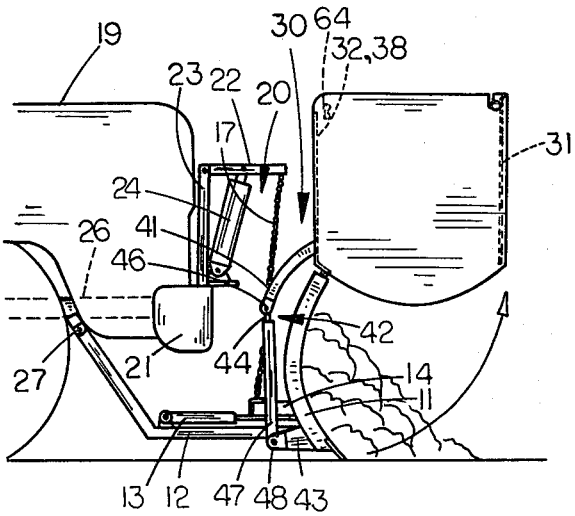
FIG. 4 is a right side elevational view of my improved snow blade with side panels and bottom panel moved upwards to dump snow.
Figure 5:
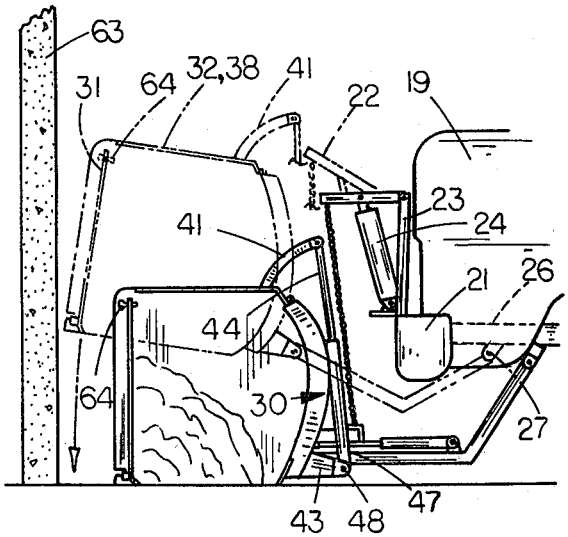
FIG. 5 is a sectional view taken along line 5—5 of FIG. 3, showing my improved snow blade in phantom lines poised above the snow level and in solid lines pulling snow away from a vertical obstacle.

Referring now to the drawings, wherein like reference numerals designate identical or corresponding parts throughout the several views, and more particularly to FIG. 1, whereon the present invention is designated generally at (10), conventional snow clearing blade (11) with portions of conventional mechanisms for supporting and maneuvering the same, designated generally at (20), are shown. The elements of supporting and maneuvering mechanisms (20) which are visible in FIG. 1 are support frame (12), two hydraulic blade angling cylinders (13), track (14), track guide (16), and lift chain (17) (see also FIGS. 2 and 4). Seen only in FIG. 2 is pivot wheel assembly (18) and elements of supporting and maneuvering mechanisms (20) seen in FIGS. 4 and 5 are utility vehicle (19), bumper (21), pivoting lever (22), lever support (23), hydraulic lifting cylinder (24), vehicle main frame (26), and hinge pin connection (27). These conventional elements of support and maneuvering mechanisms (20) are connected among themselves and function in a well known manner to push snow with snow blade (11), lift snow blade (11) above the ground and angle it either left or right.

Referring again to FIG. 1, the accessories comprising my improvement are a right side panel (28), a left side panel (29) and a bottom panel (31). Right side panel (28) is affixed along its top edge and at right angles to right triangular top panel (32). Top panel (32) is in the shape of a right triangle, its longer right angled leg (33) being attached to the right upper edge (34) of blade (11) by inner hinge (36) and outer hinge (37). Left side panel (29) is hingedly connected through left top panel (38) to the left upper edge (39) of snow blade (11) in a manner identical to that of right side panel (28). Accordingly, and as best seen in FIG. 4, both side panels can pivot about an axis co-linear with the upper edge of snow blade (11). As seen in FIG. 2, either side panel may pivot independently of the other.

Figure 3:
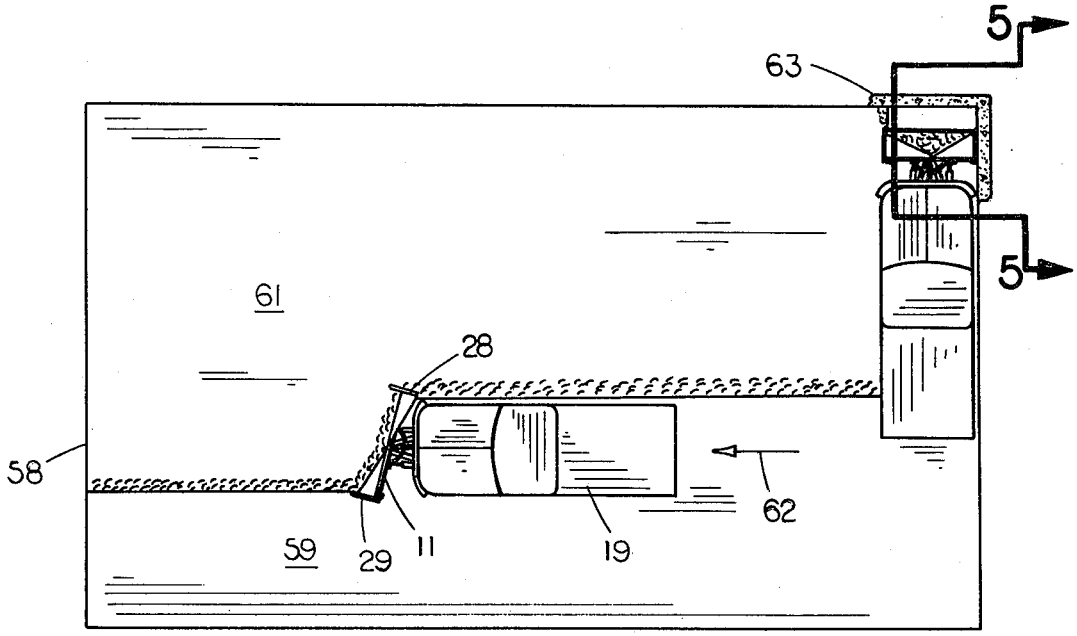
FIG. 3 is a reduced top plan view showing my improved snow blade without the bottom panel in place clearing snow in the central part of an area and with the bottom panel in place and pivoted vertically clearing snow from a corner bounded by vertical obstacles.

Not shown in FIGS. 1 and 3 and only shown in FIGS. 2, 4 and 5 are both a left and right side panel hydraulic lifting mechanism, designated generally thereon at (30). As in the case of the conventional hydraulic elements heretofore set forth, hydraulic lines, motors, pumps and other elements essential to hydraulic power are not shown in conjunction with mechanism (30), it being understood that in all such instances the same can be provided in a well known manner. As best seen in FIGS. 4 and 5, each hydraulic lifting mechanism (30) includes a rearwardly extending curved arm (41) affixed to the top of either top panel (32) and (38) (see FIG. 2), hydraulic cylinder and piston assembly (42), and rearwardly projecting lower support (43) affixed to the lower rear side of blade (11) directly beneath arm (41). The piston portion (44) of hydraulic cylinder (42) is journalled within clevis (46) of arm (41) and the cylinder portion (47) of hydraulic cylinder (42) is journalled within clevis (48) of support (43). The position of side panels (28) and (29) can be independently controlled by extending or retracting either piston (44).

Removable bottom panel (31) (best seen in FIG. 1) completes the improvement to conventional snow blade (11). The trailing edge (49) of bottom panel (31) is supported by the lower edge (not visible in FIG. 1) of snow blade (11) and the leading edge (51) of bottom panel (31) is supported at either end by side panels (28) and (29). The support of the ends of edge (51) is accomplished by upright tabs (52) each having an outwardly projecting post and cap arrangement (53) located thereon and an inverted L-shaped slot (54), in each side panel (28) and (29), opening onto their leading edges (56) and located in their lower leading corners (57).

When post and cap arrangements (53) are dropped into the vertical legs of slots (54) they will remain in slots (54) unless the operator lifts them first upwardly and then outwardly. They will not fall out of slots (54) when bottom panel (31) is pivoted upwardly to the vertical position (see FIG. 5 and phantom lines in FIG. 1) or when both side panels (28) and (29) are simultaneously pivoted upwardly (see FIG. 4). The manner of use of removable bottom panel (31) in conjunction with side panels (28) and (29) and blade (11), as well as the purpose of its horizontal and vertical positions will be explained hereinbelow.

Referring now to FIG. 3, utility vehicle (19) is shown in transit across the length of a partially cleared paved area (58), the cleared portion thereof designated at (59) and the uncleared portion at (61). Blade (11) is angled so as to cause snow to slide to the right onto uncleared portion (61) as vehicle (19) moves in the direction of arrow (62). As can also be seen in FIG. 2, right side panel (28) is pivoted to its upwards position in order to permit snow to slide across blade (11) onto uncleared area (61). Left side panel (29) remains in its downwards position in order to prevent the snow from escaping around the adjacent edge of blade (11) onto the previously cleared area (59). It should be appreciated that without side panel (29) in the downward position the only way to avoid snow from being returned to the cleared area (59) is to take a much narrower swath through uncleared portion (61). When vehicle (19) reaches the end of its present swath through paved area (58), it may then maneuver into an adjacent return swath in the opposite direction. At that moment right side panel (28) is lowered and left side panel (29) is raised, and the angle of blade (11) is reversed. Thus, the improved blade is able to take wider swaths through any area to be cleared and as a consequence, reduce the total number of trips required.

Depending upon the size of the paved area to be cleaned, as well as the quantity of snow which has fallen, it sometimes becomes necessary to interrupt the back-and-forth snow clearing procedure described above in order to move a large accumulation of cleared snow to a remote location. With my improved snow blade, it is possible to form a shovel of side panels (28) and (29) and bottom panel (31). A shovel is formed by moving both side panels into the lowermost position where their trailing edge is in contact with the outer edges of blade (11) and then to drop the bottom panel (31) into place as described hereinabove. These positions of the three elements are seen in solid lines in FIG. 1. After arriving at a remote location with a quantity of transported snow, both side panels (28) and (29) are pivoted upwardly along with bottom panel (31) as seen in FIG. 4, the transported snow automatically dropping to the ground in front of blade (11).

Another use of bottom panel (31) is to remove snow from corners bounded by vertical obstructions (63) as shown in the upper right corner of FIG. 3. Snow is removed therefrom by first pivoting the trailing edge of bottom panel (31) upwardly until it is held in position by two spring clips (64) each one of which is located in the inner, upper leading corner of each side panel (28) and (29). This position of bottom panel (31) is shown in phantom lines in FIG. 1. As seen in FIG. 5, snow blade (11) is then pivoted upwardly in conventional fashion about hinge pin connection (27) and vehicle (19) is moved forward until vertically oriented bottom plate (31) is located substantially adjacent to and parallel to a portion of obstruction (63). Blade (11), along with bottom plate (31) is then pivoted downwardly in a conventional manner until a quantity of snow is trapped between bottom plate (31) and snow blade (11). Vehicle (19) is then backed away from obstruction (63) in order to pull the quantity of snow so trapped, as well as any snow which may also be behind snow blade (11) away from obstruction (63). Without the accessories comprising my improvement, a conventional snow blade in combination with a conventional supporting and maneuvering mechanism could not be used to remove snow from corners bounded by such vertical obstructions. In such instances, it would be necessary for the operator to abandon his equipment and manually shovel the snow.

Accordingly, it is believed that all of the objects mentioned above are accomplished by use of the best mode for carrying out the invention disclosed herein. Obviously, many modifications and variations of the present invention are possible in light of the above teachings. It is therefore to be understood that, within the scope of the appended claims, the invention may be practised otherwise than as specifically described.

I claim:

1. A blade for clearing snow of a type having a vertical cross-sectional conformation of a generally circular segment to which pushing, angling and lifting means are attached, the improvement comprising a left and right side panel disposed substantially normal to said blade, each having hinging means for pivoting it, independent of the other, about the top edge of the blade, whereby each panel can be held at a lower position to block the snow around the adjacent side edge of the blade and pivoted upwardly to a position permitting the escape of snow, wherein each side panel is attached to its hinging means by a top panel, one side of which extends along the adjacent one-half length of the top edge of the blade and another side of which extends along the top edge of the side panel.

2. The snow blade of claim 1, the improvement further comprising means for moving each of the side panels about the hinging means, each of said moving means being connected between and acting between the side panel and the blade.

3. The snow blade of claim 1 wherein each side panel is so conformed that its lower edge, when in the lower position, is in the same generally horizontal plane as the lower edge of the blade.

4. The snow blade of claim 1 including a bottom panel removably attached to the side panels, whereby the blade, side panels and bottom panel can function as a shovel when the side panels are in the lower position.

5. The snow blade of claim 4 including means for pivoting the bottom panel substantially from a horizontal position where its trailing edge rests on the lower edge of the blade to a substantially vertical position disposed away from the blade, and a means for removably holding it in the vertical position, whereby snow can be effectively be pulled away from bounding obstructions and snow can be dumped when the improved blade is functioning as a shovel.

6. The snow blade of claim 5 wherein the bottom panel pivoting means is further characterized as having a post projecting outwardly from the leading corner of each side of the bottom panel and an inverted L-shaped access for each post in the leading lower corner of each side panel.

* * * * *